US006283296B1

(12) United States Patent
Newman

(10) Patent No.: US 6,283,296 B1
(45) Date of Patent: Sep. 4, 2001

(54) QUILTED INFLATABLE PACKAGING DEVICE

(75) Inventor: Garry F. Newman, Castaic, CA (US)

(73) Assignee: Air Packaging Technologies, Inc., Valencia, CA (US)

( * ) Notice: Subject to any disclaimer, the term of this patent is extended or adjusted under 35 U.S.C. 154(b) by 0 days.

(21) Appl. No.: 09/474,310

(22) Filed: Dec. 29, 1999

Related U.S. Application Data

(60) Provisional application No. 60/114,205, filed on Dec. 29, 1998.

(51) Int. Cl.[7] ..... B65D 81/03

(52) U.S. Cl. ..... 206/522; 383/3; 493/189

(58) Field of Search ..... 206/316.2, 320, 206/521, 522, 523, 583, 591, 594; 383/3; 493/189, 206–209

(56) References Cited

U.S. PATENT DOCUMENTS

| | | | | |
|---|---|---|---|---|
| 3,889,743 | | 6/1975 | Presnick | 165/46 |
| 4,465,188 | * | 8/1984 | Soroka et al. | 206/522 |
| 4,872,558 | | 10/1989 | Pharo | 206/522 |
| 4,874,093 | | 10/1989 | Pharo | 206/522 |
| 4,905,835 | | 3/1990 | Pivert et al. | 206/522 |
| 4,918,904 | | 4/1990 | Pharo | 53/472 |
| 4,949,530 | | 8/1990 | Pharo | 53/449 |
| 5,180,060 | | 1/1993 | Forti et al. | 206/522 |
| 5,217,131 | * | 6/1993 | Andrews | 206/522 |
| 5,263,587 | * | 11/1993 | Elkin et al. | 206/522 |
| 5,272,856 | | 12/1993 | Pharo | 53/472 |
| 5,427,830 | * | 6/1995 | Pharo | 206/522 |
| 5,445,274 | | 8/1995 | Pharo | 206/522 |
| 5,447,235 | | 9/1995 | Pharo | 206/522 |
| 5,454,642 | * | 10/1995 | De Luca | 206/522 |
| 5,487,470 | | 1/1996 | Pharo | 206/522 |
| 5,588,532 | | 12/1996 | Pharo | 206/522 |
| 5,628,402 | | 5/1997 | Dickie et al. | 206/521 |
| 5,762,197 | | 6/1998 | Farison | 206/522 |
| 5,769,231 | | 6/1998 | Batsford | 206/522 |
| 5,791,477 | | 8/1998 | Batsford | 206/522 |
| 5,803,263 | | 9/1998 | Pozzo | 206/522 |
| 5,819,942 | | 10/1998 | Sadow | 206/522 |
| 5,857,571 | * | 1/1999 | Tschantz et al. | 206/522 |
| 5,862,914 | | 1/1999 | Farison et al. | 206/522 |

* cited by examiner

*Primary Examiner*—Jim Foster
(74) *Attorney, Agent, or Firm*—Madson & Metcalf

(57) ABSTRACT

An inflatable packaging device has an outer bag having a pair of overlying outer panels. The outer panels have outer peripheral edges which are sealed together along at least a portion of the outer peripheral edges to define a chamber between the outer panels. The device also has an inner bag disposed within the chamber. The inner bag has a pair of overlying inner panels which define a pocket. The pocket is configured to retain an article. The inner panels have inner peripheral edges which are secured to adjacent outer peripheral edges along at least a portion of the outer peripheral edges. The securement of the inner panels to the outer panels suspends the inner bag within the chamber. The inner bag separates the chamber into upper and lower sub chambers which are in communication with one another through a passage between the inner panels. Adjacent inner and outer panels are further sealed together at a plurality of locations to form quilt seals traversing the surfaces of the outer and inner panels. The quilt seals include seals oriented in longitudinal and lateral directions to force the device to conform to an approximate cube or rectangular shape upon inflation of the chamber. The inner and outer panels are further sealed in such a manner to define an aperture in communication with the pocket. An item may be inserted through the aperture into the pocket.

29 Claims, 7 Drawing Sheets

QUILTED INFLATABLE PACKAGING DEVICE

RELATED APPLICATIONS

This application claims priority to patent application No. 60/114,205, filed Dec. 29, 1998 and entitled "Quilted Inflatable Packaging Device."

BACKGROUND

1. The Field of the Invention

The present invention is related to packaging devices and more specifically to air packaging devices employing quilting.

2. The Background Art

Conventional packaging incorporates a variety of materials to protect and insulate a packaged item. One of these conventional packaging materials is known as "bubble-pack." Bubble-pack consists of two layers of thin plastic material, such as polyethylene or vinyl formed with random bubbles between the layers and filled with air at time of manufacture. Bubble-pack requires large rolls of bubble material that displace a great deal of volume in storage before use.

Bubble-pack is bulky, and therefore expensive to ship and to store during the period before it is put to use. Furthermore, conventional bubble-pack provides limited protection in certain applications because of the fixed bubble diameter, height, and count in a given material area.

Another conventional packaging material is pre-shaped styrofoam objects. An example of this is styrofoam "peanuts," which are distributed in mass around a packaged article. Another example is pre-formed styrofoam blocks which are fitted to restrain a packaged item. Styrofoam blocks prevent the packaged item from moving in directions during travel. Styrofoam material experiences some of the same disadvantages of the bubble-pack. Styrofoam material is bulky and expensive to ship and store. Furthermore styrofoam provides limited protection in certain applications because of the fixed dimensions and shape of the styrofoam.

Inflatable packaging devices have overcome some of the limitations of previous packaging materials. Inflatable packaging devices may be shipped and stored in a deflated condition, thereby reducing the expense of shipment and storage. Furthermore, inflatable packaging devices provide cushions of filler material, such as air, which is under pressure. The filler material functions to absorb and redistribute forces acting on the packages, thereby protecting a delicate item of merchandise encapsulated and suspended therein. Articles encapsulated by the inflatable packaging device are prevented from substantially moving in directions relative to the packaging.

The following list of patents disclose several improvements of inflatable packaging devices and are hereby incorporated by reference:

U.S. Pat. No. 4,597,244, issued Jul. 1, 1986 for "Method For Forming An Inflated Wrapping;"

U.S. Pat. No. 4,793,123, issued Dec. 27, 1988 for "Rolled-up Packaging System and Method;"

U.S. Pat. No. 4,872,558, issued Oct. 10, 1989, for "Bag-In-Bag Packaging System;"

U.S. Pat. No. 4,918,904, issued Apr. 24, 1994, for "Clam-Like Packaging System;"

U.S. Pat. No. 4,949,530, issued Oct. 21, 1994, for "Method for Forming Bag-In-Bag Packaging System;"

U.S. Pat. No. 5,272,856, issued Dec. 28, 1993, for "Packaging Device That is Flexible, Inflatable, and Reusable and Shipping Method Using the Device;"

U.S. Pat. No. 5,427,830 issued Jun. 27, 1995, for "Continuous, Inflatable Plastic Wrapping Material;"

U.S. Pat. No. 5,445,274, issued Aug. 29, 1995, for "Inflatable Package Insert;"

U.S. Pat. No. 5,447,235 issued Sep. 5, 1995, for "Bag With Squeeze Valve and Method For Packaging an Article Therein;"

U.S. Pat. No 5,487,470 issued Jan. 30, 1996, for "Merchandise Encapsulating Packaging System and Method Therefor;"

U.S. Pat. No. 5,588,532 issued Dec. 31, 1996, for "Self-Sealing Inflatable Bag and Method For Packaging an Article Therein;" and U.S. Pat. No. 5,711,691 issued Jan. 27, 1998 for "Self-Closing and Self-Sealing Valve Device For Use With Inflatable Structures."

Some of the above patents disclose air packaging devices involving distinct, separate pouches or bags that are manufactured from two or more plies. For example, several of the inventions disclose a four-ply bag, which are used to form outer and inner chambers. The outer chamber is inflated with a filler material, such as air and is separated from the inner chamber. The inner chamber retains the packaged item, thereby providing a total air cushion around the product.

A disadvantage of these air packaging devices is that they are bulky when inflated, and require a substantial amount of packaging space. Furthermore, the shapes they take when inflated are often not convenient for packaging in containers having cubical dimensions. This entails increased cost for the increased amount of packaging space required.

Therefore, it would be advantageous in the art to provide a packaging device with advantages of previous air packaging systems, while providing improved packaging dimensions. It would be a further advancement in the art to provide an air packaging device which provides more resistance to swelling due to changes in air pressure. It would be yet another advancement in the art to provide an air packaging device which provides superior contact with an exterior container to reduce the effect of impact forces.

Such a device is disclosed and claimed herein.

BRIEF SUMMARY OF THE INVENTION

The present invention is directed to an inflatable packaging device with an outer bag having a pair of overlying outer panels. The outer panels have outer peripheral edges which are sealed together along at least a portion of the outer peripheral edges. The outer bag defines a chamber between the outer panels. The device also has an inner bag disposed within the chamber. The inner bag has a pair of overlying inner panels which define a pocket. The pocket is configured to retain an article. The inner panels have inner peripheral edges which are secured to adjacent outer peripheral edges along at least a portion of the outer peripheral edges. The securement of the inner panels to the outer panels suspends the inner bag within the chamber. The inner bag separates the chamber into upper and lower sub chambers which are in communication with one another through a passage between the inner panels.

The inner and outer panels are further sealed in such a manner to define an aperture in communication with the pocket. This permits the insertion of an item into the pocket.

A flow channel, such as a valve, is disposed on the outer panel and is in communication with the chamber. Inflation and deflation of the device may be accomplished by the flow channel.

Adjacent inner and outer panels are further sealed together at a plurality of locations to form quilt seals traversing the surfaces of the outer and inner panels. The quilt seals include seals oriented in longitudinal and lateral directions to force the device to conform to an approximate cube or rectangular shape upon inflation of the chamber.

Thus, it is an object of the invention to provide an inflatable air packaging device which is inflatable into desired dimensions to facilitate shipping and provide added resistance to impact.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
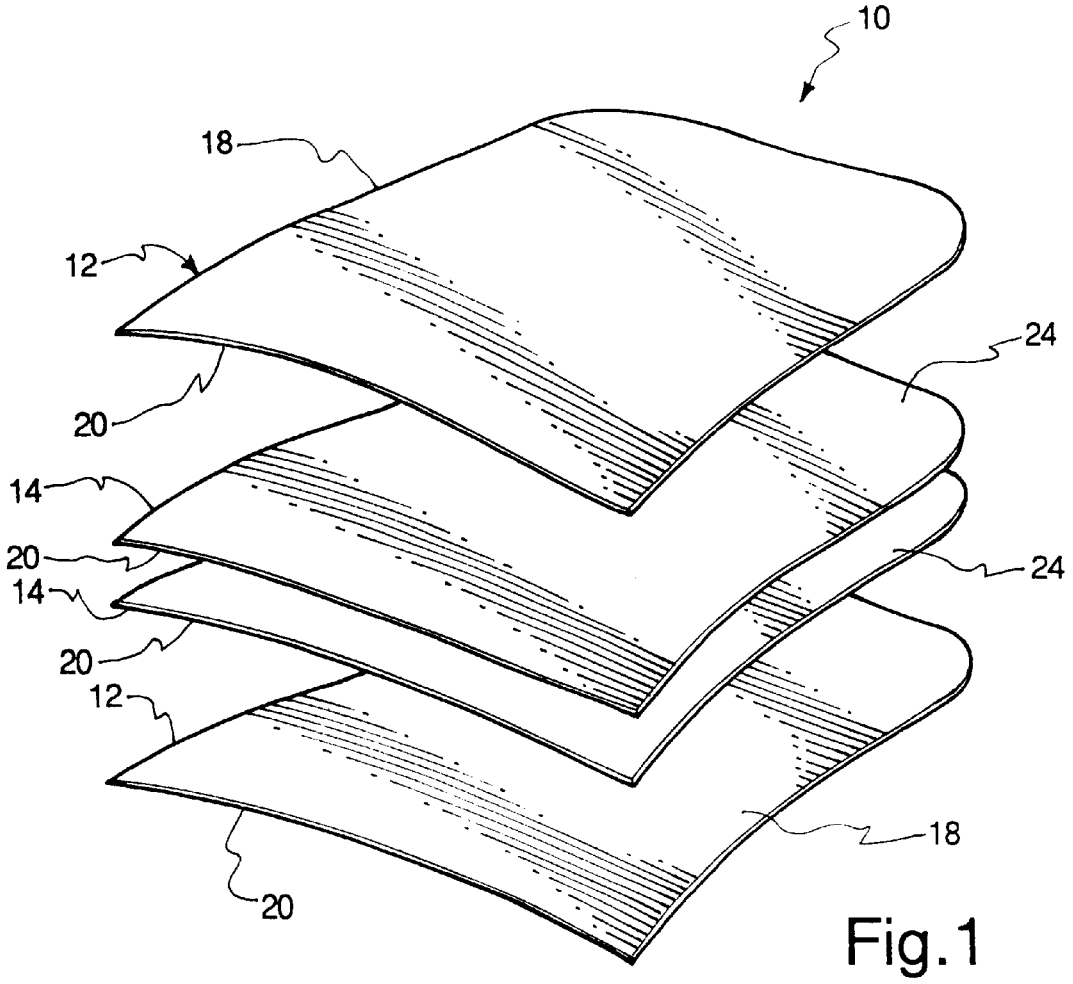
FIG. 1 is a perspective view of panels for use with the present invention.

Referring to FIG. 1 there are shown overlying panels 10 which may be incorporated into n embodiment of the present invention. The panels 10 include a pair of outer panels 12 and inner panels 14 which may be configured in a general rectangular shape. The panels 10 are suitably cut and sealed together using conventional apparatus and methods. Such sealing methods include heat sealing the panels 10 at select areas to form a packaging device of the present invention. The panels 10 are preferably composed of a flexible, gas impervious composite laminate and are adapted to melt in the range of 300 degrees F. The panels 10 of the device may be formed from a variety of polymers comprising various amounts of polyethylene, nylon, and metallocene. Aspects of the four panel packaging system are generally disclosed in further detail in U.S. Pat. No. 4,872,558 to Pharo. Such types of composite laminates are well known in the art.

Figure 2:
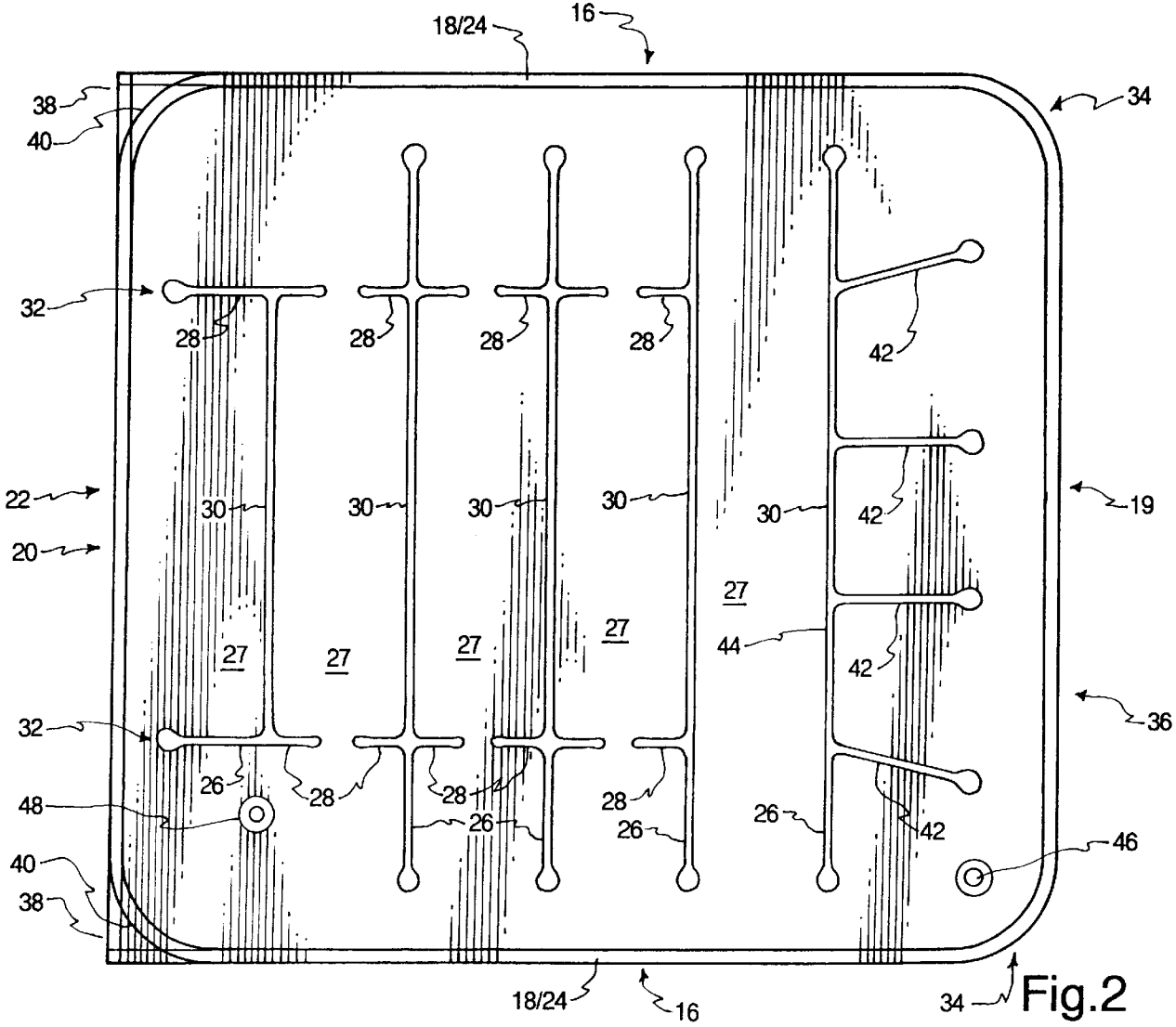
FIG. 2 plan view of one embodiment of the air packaging device of the present invention.

Referring to FIG. 2, and with continued reference to FIG. 1, a plan view of one embodiment of the packaging device 14 is shown. The device 16, comprises the four overlying panels 10 shown in FIG. 1. The outer panels 14 have outer peripheral edges 18 which are sealed to one another. In this manner, the outer panels 14 define a chamber within. In one embodiment, the outer peripheral edges 18 are sealed to one another along three sides 19. The fourth or open side 20 is configured to define an aperture 22 for receiving an article. The outer peripheral edges 18 are not sealed on the open side 20 or are partially sealed on the open side 20 to one another.

The inner panels 14 are disposed between the outer panels 12 and within the chamber defined by the outer panels 12. The inner panels 14 define an inner chamber or item receiving pocket to hold an item to be shipped. The inner panels 14 have inner peripheral edges 24 which are sealed to adjacent outer peripheral edges 18. In one embodiment, an inner panel 14 is sealed to an adjacent outer panel 12 at their respective peripheral edges 18, 24 along all four sides 19, 20. The inner panels 14 are further sealed to one another along their inner peripheral edges 24 along three sides 19, with the open side 20 remaining at least partially unsealed to define an aperture 22.

Each outer panel 12 is further sealed to its adjacent inner panel 14 at certain locations to cause the packaging device 16 to conform to a desired shape when inflated. Such seals which are not disposed along the peripheral edges 18, 24 are herein referenced as quilt seals 26. The quilt seals 26 do not reduce the amount of protection afforded by the packaging device 16 but do provide a number of advantages as discussed herein. Several quilt seals 26 are shown in FIG. 2 that traverse the surfaces of the outer and inner panels 12, 14 and form a series of passages 27 between the outer and inner panels 12, 14. The passages 27 are in communication with one another to allow inflation of the entire chamber. An opposing side of the packaging device 16, although not shown in FIG. 2, has a mirror set of quilt seals 26.

The quilt seals 26 are disposed over the surface of the panels 12, 14 such that when the device 16 is inflated it will have approximately 1 to 2 inches of cushion barrier between the outside and inside of the device 16. The distances between any two quilt seals 26 are held normally to no more than 4 inches apart. This feature controls the force inside the packaging device 16 to not exceed the yield strength of the outside laminate during normal usage and at altitudes up to 15,000 feet during air shipments. One of skill in the art will appreciate that such specifications are only given as one possible embodiment. Embodiments with different dimensions are possible and are included within the scope of the invention.

The packaging device 16 may be inserted into exterior packaging such as a corrugated box. Depending on the application, a plurality of devices 16 may be inserted into an exterior container. The distances between various quilt seals 26 are spaced strategically to form bulges for compression against an exterior container or other devices 16. These bulges generate an appropriate amount of force to resist compression for controlling the g-forces exerted on the item when free-fall dropped. The force to compression length ratio is critical in providing low g-force results during free-fall drop testing.

The quilt seals 26 shown in FIG. 2 cause the packaging device 16 to conform to approximately a cube or rectangular shaped object when the device 16 is inflated. Thus, when inflated, the device 16 will have six surfaces, with one surface being configured with an aperture 22. Placement of packaging devices 16 into rectangular exterior containers, such as a corrugated box, is facilitated if the packaging device 16 is cube shaped. This allows for more efficient packaging and reduces wasted space. Furthermore, a packaging device 16 with a cubed dimension will have greater surface area contact with an exterior container. By having a proper distribution of quilt seals 26, and greater contact with an exterior container, the gravitational forces applied to the packaging device 16 will be minimized.

A further advantage of the quilt seals 26 is that they reduce the amount of additional volume that the device 16 requires. Accordingly, less overall packing space is required. The quilt seals 16 further reduce swelling in the devices 16.

At times during air travel, packages may be subject to severe reduction in air pressure which causes swelling of an inflatable air package. In some cases, the swelling may even lead to an explosion of the inflatable package device. The quilt seals 26 reduces swelling which may occur during shipping.

Quilt seals 28 which are disposed along the length of the device 16 or which are oriented in a longitudinal direction are referenced herein as longitudinal quilt seals 28. Quilt seals 30 which are disposed along the width of the device or which are oriented in a lateral direction are referenced herein as lateral quilt seals 30. The longitudinal quilt seals 28 may be disposed in columns 32 oriented in a longitudinal direction. In one embodiment, there are four columns 32 of longitudinal quilt seals 28 which approximate four corners of a rectangular shape when the device 16 is inflated. The lateral quilt seals 30 cause the surfaces of the device 16 to conform to a generally planar shape rather than a bulbous shape when inflated. The lateral quilt seals 30 may extend across one or more surfaces of the inflated device 16 to create a planar configuration of the surfaces.

The panels 10 may be further configured with rounded bottom corners 34 on a bottom side 36. The rounded bottom corners 34 add strength and durability to the packaging device 16. As the packaging device 16 may be commonly inserted into a receiving container with the open side 20 oriented upward, the corners 34 will be subjected to stress and wear. The rounded bottom corners 34 reduce the amount of stress and wear provide a more resilient device 16.

The upper corners 38 may likewise be configured as rounded corners. Alternatively, the upper corners 38 may form right angles as shown in FIG. 2. In the embodiment of FIG. 2, the outer and inner panels 12, 14 are sealed together adjacent the upper corners 38 to form radial seals 40. The radial seals 40 depart from the sealed outer and inner peripheral edges 18, 24 and curve interior to their respective upper corner 38. In this manner, the radial seals 40 provide additional resistance for the upper corners 38 against stress and wear.

The device 16 may further be configured with quilt seals 42 adjacent the bottom side 36 of the outer and inner panels 12, 14 and are herein referenced as bottom support seals 42. The bottom support seals 42 are formed by sealing adjacent outer and inner panels 12, 14 together as with other quilt seals 26. The bottom support seals 42 may be oriented in a longitudinal direction or on an angle departing from the longitudinal direction. The bottom support seals 42 serve to cause the bottom surface of the device 16 to conform to a generally planar configuration. The bottom support seals 42 further provide strength and support for the device 16.

The bottom support seals 42 may extend from a bottom lateral quilt seal 44 as shown in FIG. 2. The bottom lateral quilt seal 44 may serve as an approximate rectangular corner of the device 16 when the device 16 is inflated.

The device 16 may further comprise an air exchange hole 46 to form a passage 46 between upper and lower sub chambers of the packaging device 16. The air exchange hole 46 may be formed by forming adjacent apertures in the inner panels 14. The apertures are sealed together along their perimeters to create the passage 46. The passage 46 allows communication of a filler medium between the upper and lower sub chambers.

The packaging device 16 further incorporates a flow channel 48 which is disposed on an outer panel 12 and in communication with the chamber. The flow channel 48 may be any number of various devices for filling the chamber with gas such as air. In one embodiment, the flow channel 48 may be a push-pull valve. The push-pull valve allows for inflation and deflation of the device 16 to permit reuse. The flow channel 48 may also be embodied as a flat valve such as that disclosed in U.S. Pat. No. 5,711,691. Ideally, the flow channel 48 is leak free and is strategically located on the packaging device 16 to allow easy inflation of the chamber and to minimize contact between the flow channel 48 and an exterior container.

Figure 3:
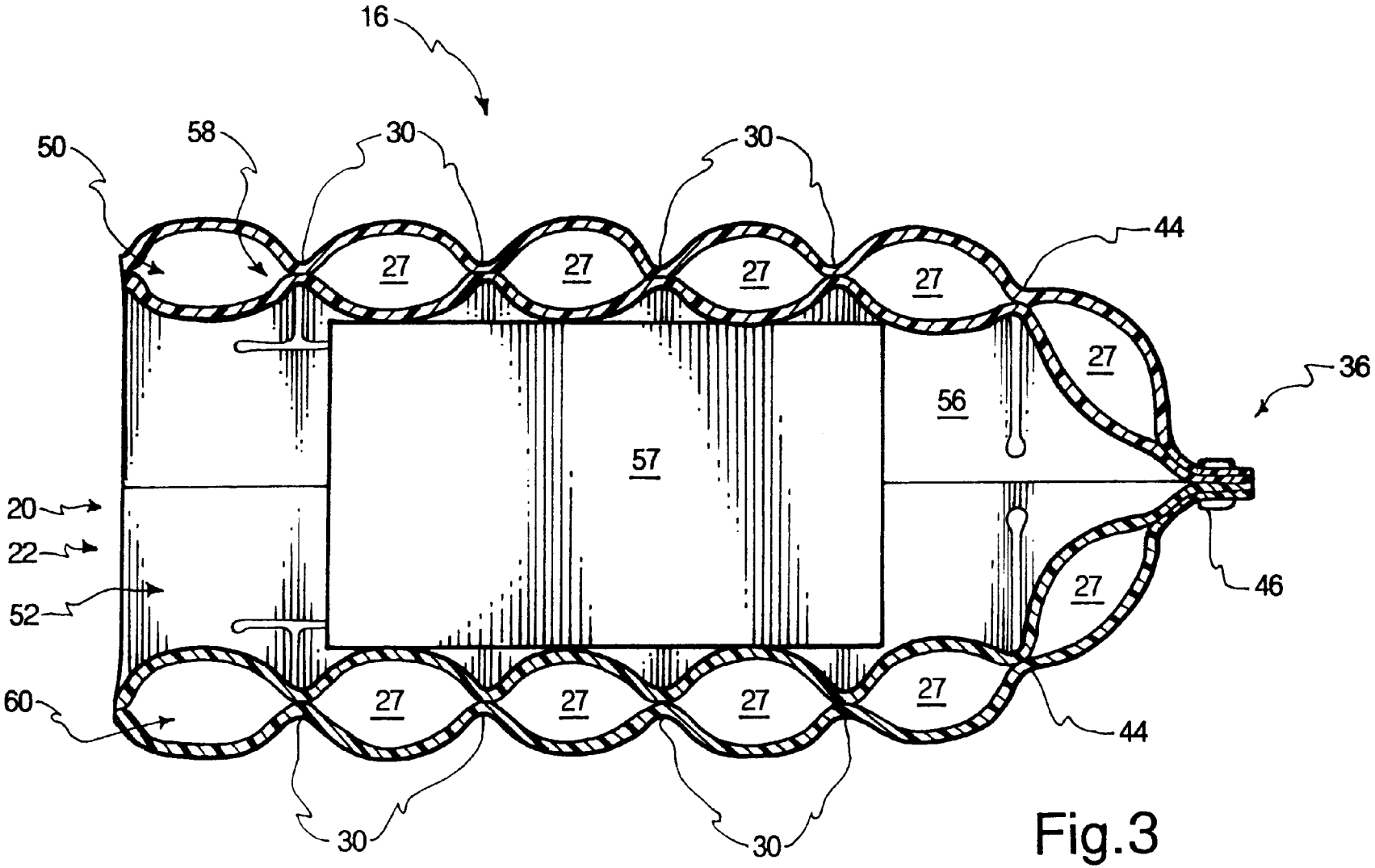
FIG. 3 is a cross sectional view of an inflated air packaging device of the embodiment of FIG. 2.

Referring to FIG. 3 a cross sectional view of an inflated packaging device 16 is shown. The device 16 has an outer bag 50 formed by the outer panels 12. The outer bag 50 defines a chamber 52 within which the inner panels 14 are disposed. The inner panels 52 defined an inner bag 54 which in turn defines an item receiving pocket 56. The pocket 56 is shown retaining an item 57.

The pocket 56 is in communication with the aperture 22 for receiving the item 57. The item may be The inner peripheral edges 24 are secured to the outer peripheral edges 18 to suspend the inner bag 54 within the chamber 52 of the outer bag 50. Thus configured, the inner bag 54 divides the chamber 52 into upper and lower sub chambers 58, 60. The upper and lower sub chambers 58, 60 are divided into passages 27 by the quilt seals 26. The quilt seals 26 permit communication of the passages 27. The cross sectional view of FIG. 3 shows primarily the lateral quilt seals 26. The upper and lower sub chambers 58, 60 are in communication with one another through the air hole exchange 46. Thus, there is communication throughout the entire chamber 52. Inflation of the entire chamber 52 may therefore be accomplished through use of the flow channel 48.

Figure 4:
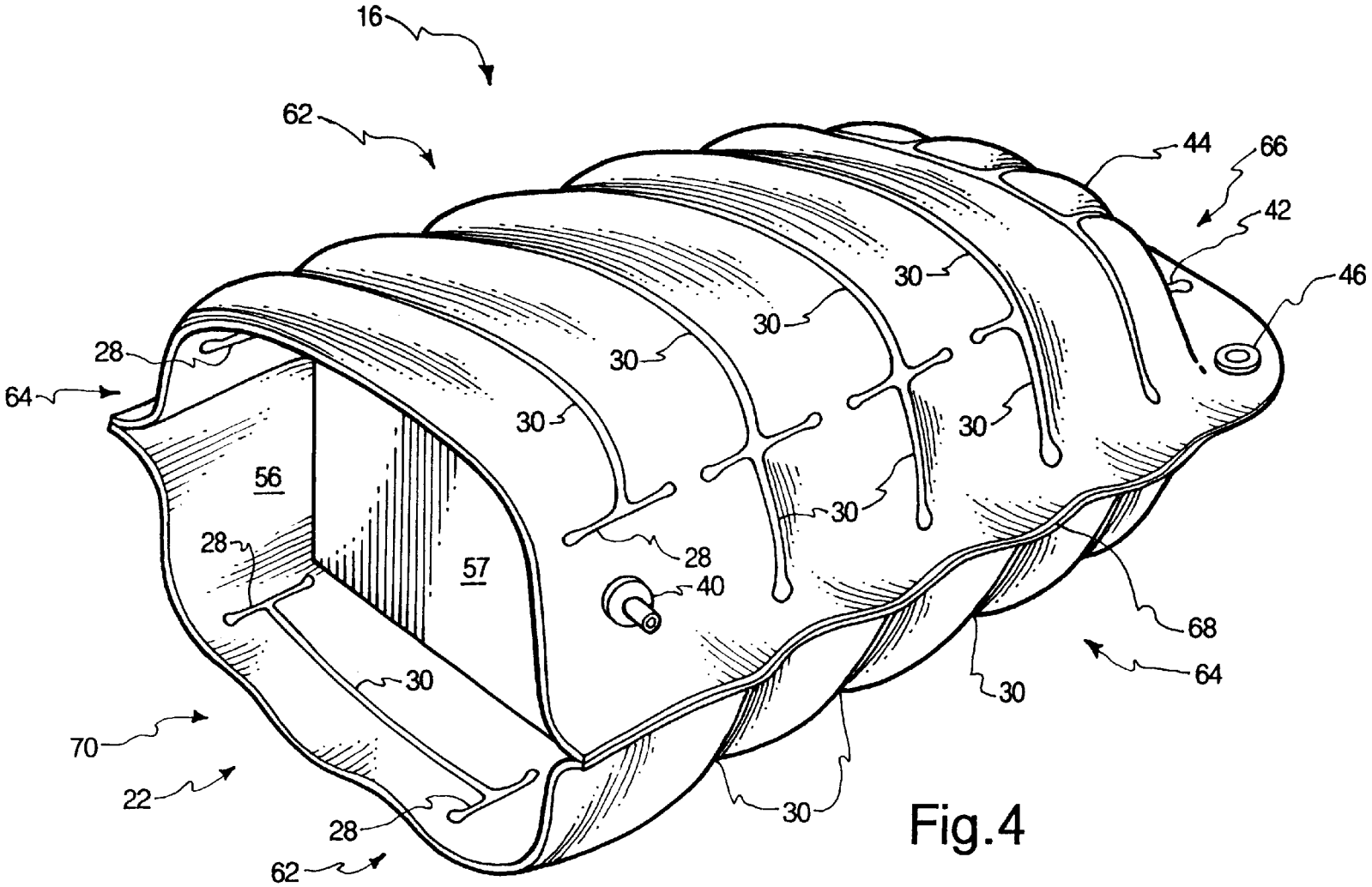
FIG. 4 is a perspective view of an inflated air packaging device of the embodiment of FIG. 2.

Referring to FIG. 4, a perspective view of an inflated packaging device 16 is shown. The device 16 is in a general rectangular configuration and has top and bottom surfaces 62, bottom surface 64, and side surfaces 66. The top and bottom surfaces 62 have lateral quilt seals 30 disposed thereon and are mirror images of one another. The top and bottom surfaces 62 have widths which are approximately defined by longitudinal quilt seals 28. The bottom surface 64 has bottom support seals 42 disposed thereon and is approximately defined by the bottom lateral quilt seals 44. The side surfaces 66 are similarly defined by the longitudinal quilt seals 28. The lateral quilt seals 30 may extend beyond the top and bottom surfaces 62 to traverse a least a portion of the side surfaces 66. A peripheral edge seam 68 defined by the sealing of the inner and outer peripheral edges traverses the approximate mid section of the side and bottom surfaces 62, 64.

A sixth surface 70 is largely defined by an aperture 22 through which an item 57 may be inserted into the pocket 56. The aperture 22 may vary in size depending on the item to be shipped and may include the entirety of the sixth surface 70.

The packaging device 16 may be used for packaging of extremely fragile materials. In one application, the device 16 may be used to package silicon wafers. The wafers may be stacked in a carrier and the carrier is then inserted into the item receiving pocket. Alternative embodiments of the quilted inflatable packaging device are designed to accommodate alternative items.

Figure 5:
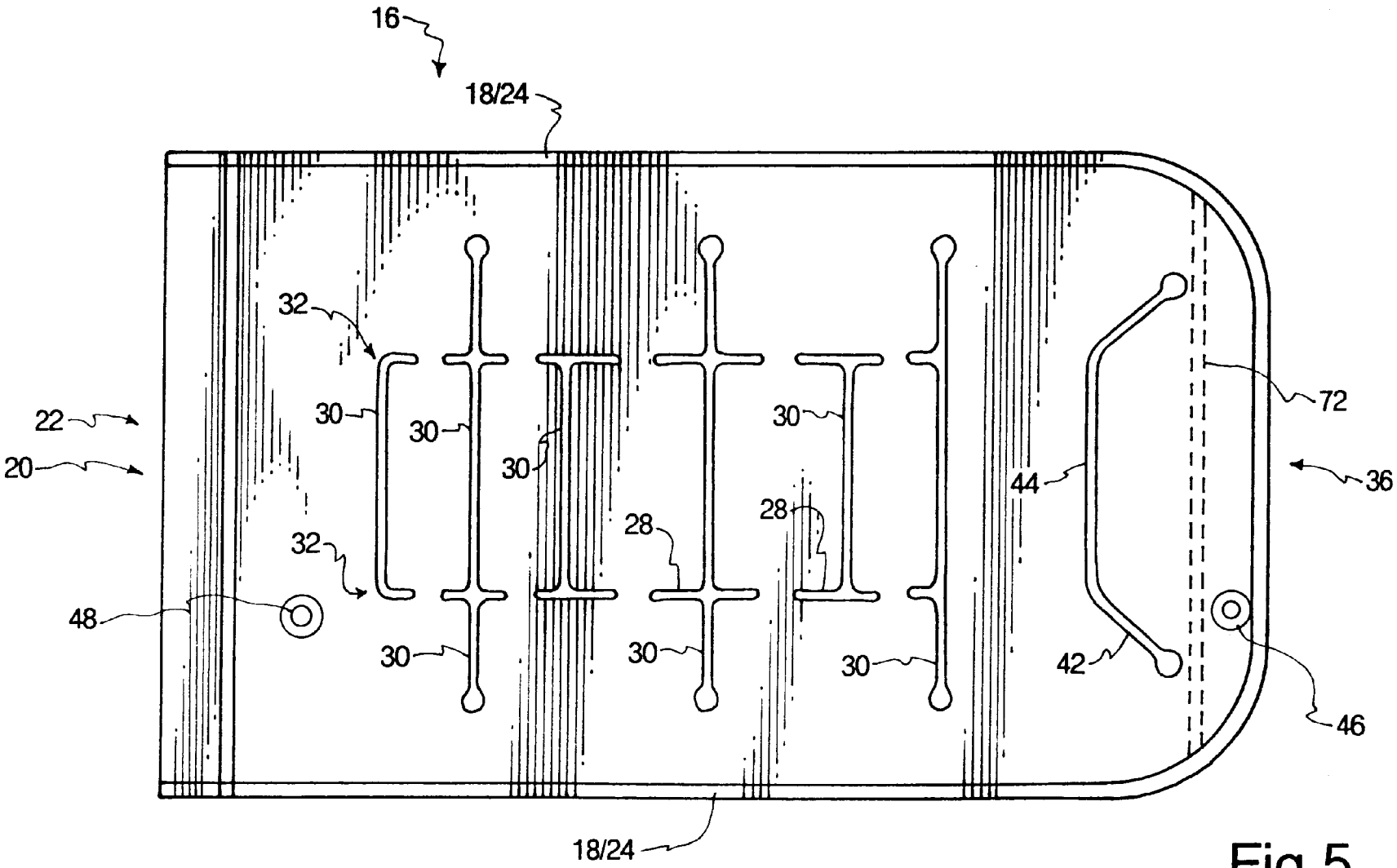
FIG. 5 is a plan view of an alternative embodiment of the air packaging device of the present invention.

Referring to FIG. 5, a plan view of an alternative embodiment of the inflatable packaging device 16 is shown. The embodiment of FIG. 5 differs from that of the embodiment of FIGS. 2–4 in the disposed arrangement of the quilt seals 26. The embodiment of FIG. 5 further comprises a restrictive seal 72 (indicated by dotted lines) which seals the inner panels 14 together. The restrictive seal 72 in the embodiment of FIG. 5 serves to limit movement of a packaged item 57.

Figure 6:
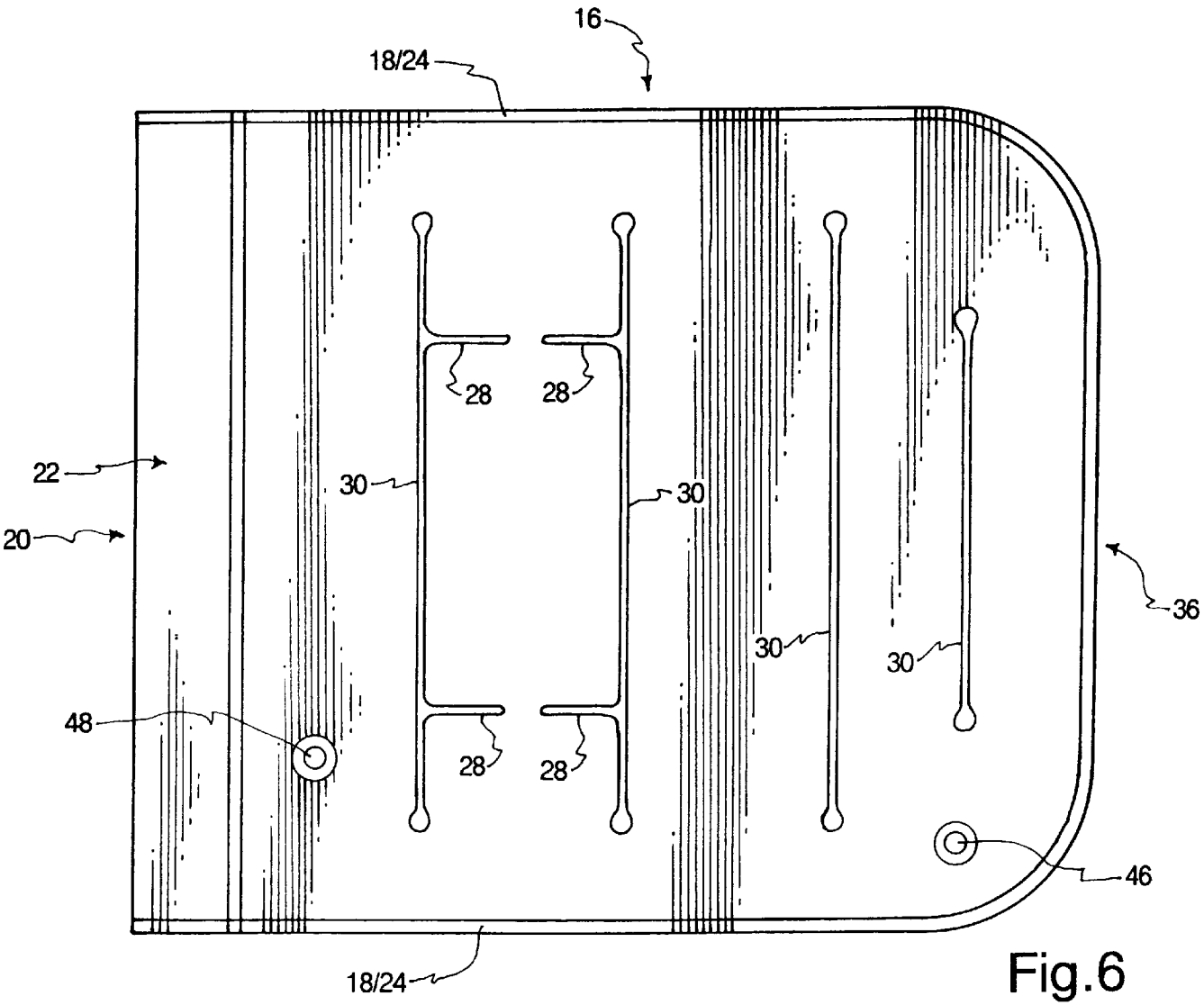
FIG. 6 is a plan view of an alternative embodiment of the air packaging device of the present invention

Referring to FIG. 6, an alternative embodiment of the inflatable packaging device 16 is shown. The embodiment of FIG. 6 differs from previous embodiments in the disposed arrangement of the quilt seals 26. The device 16 does not contain bottom support seals 42 and has fewer longitudinal seals 28.

Figure 7:
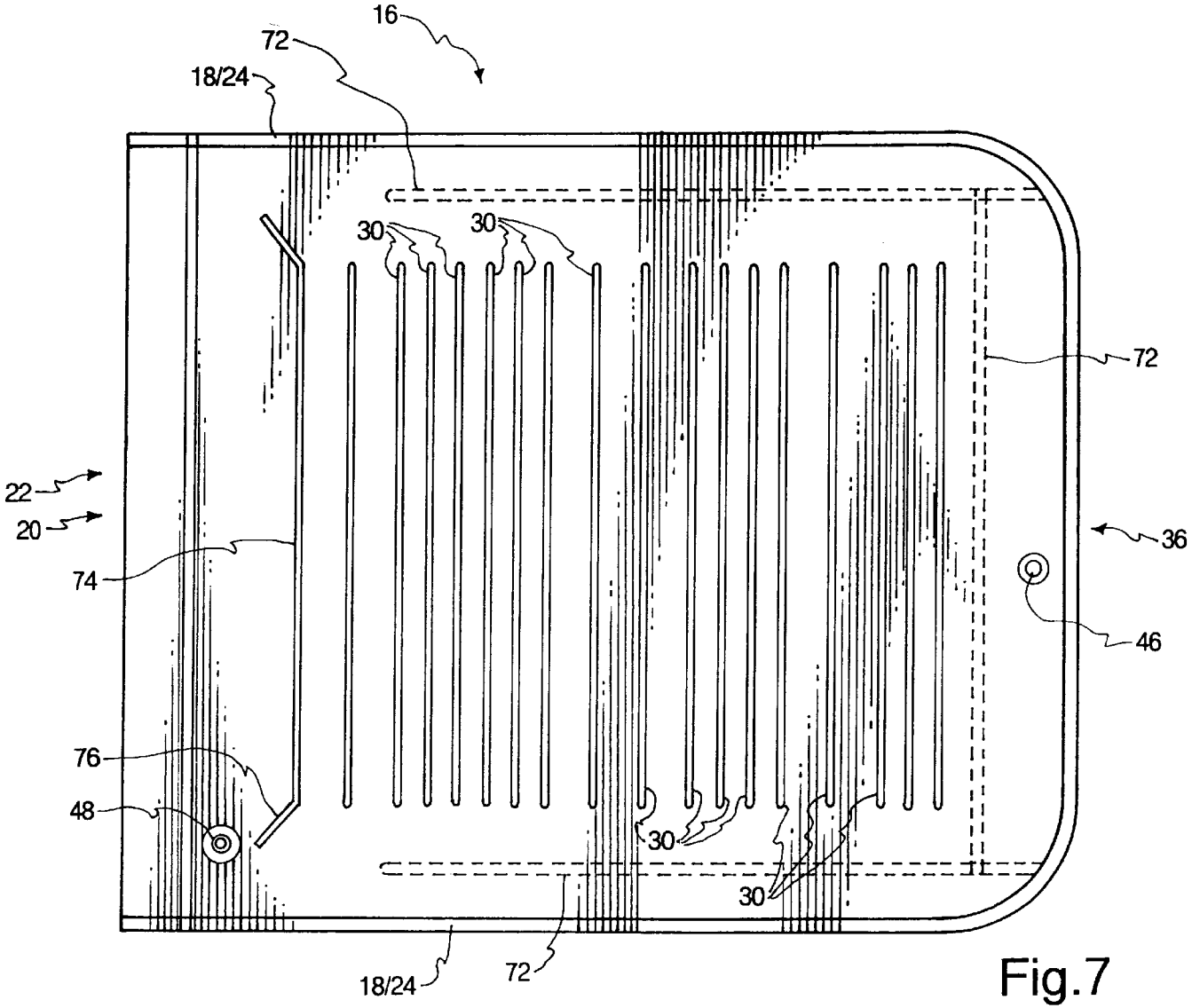
FIG. 7 is a plan view of an alternative embodiment of the air packaging device of the present invention.

Referring to FIG. 7 an alternative embodiment of the inflatable packaging device 16 is shown. The embodiment of FIG. 7 primarily differs from previous embodiments in that the quilt seals 26 are disposed primarily in a lateral direction and not in a longitudinal direction. Without the longitudinal quilt seals 28, the inflated packaging device 16 will not form a rectangular configuration. Instead, the inflated packaging device 16 forms an envelope having primarily two surfaces with an item disposed between two layers of quilted chambers. Such an embodiment is usefull for the packaging of a tape and reel.

The device 16 further comprises a restrictive seal 72 which is indicated by dotted lines. The restrictive seal 72 is formed by the sealing of the inner panels 14 as in the embodiment of FIG. 5. The restrictive seal 72 further defines the shape of the item receiving pocket 56. The restrictive seal 72 also prevents movement of the item during shipping. When the packaging device 16 is inflated, the quilt seals 26 and the restrictive seal 72 define a flat, wedged shaped item receiving pocket 56.

Spacing of the quilt seals 26 is done in such a manner that flat drops of the packaging device 16 experience lower gravitational forces. In one presently preferred embodiment, this is done by unevenly distributing the quilt seals 26 such that one or more quilt seals 26 are not equidistant from other quilt seals 26. Irregular distribution of the quilt seals 26 lessens the accumulative resistance force and lowers the gravitational force experienced by the packaging device 16 during a flat drop.

The embodiment of FIG. 7 further comprises an shovel mouthed quilt seal 74 having angled ends 76. The shovel mouthed quilt seal 74 is disposed adjacent the open end 20 of the packaging device 16. The shovel mouthed quilt seal 74 assists in closing the aperture 22 to better retain an item 57 within the pocket 56.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention.

What is claimed is:

1. An air packaging device, comprising:

an outer bag having a par of overlying outer panels defining a chamber therein, the outer panels having outer peripheral edges sealed together along at least a portion of the outer peripheral edges;

an inner bag disposed within the chamber and secured to the outer bag, the inner bag having a pair of overlying inner panels defining a pocket configured to retain an article therein, the inner panels having inner peripheral edges; and the adjacent inner and outer panels sealed together at a plurality of locations to form, four symmetrical longitudinal columns, each longitudinal column having opposing ends spaced from one another and a plurality of longitudinal quilt seals, each longitudinal quilt seal having ends spaced from one another, each column approximating a surface edge upon inflation of the chamber, upper lateral quilt seals traversing between first and second longitudinal columns and intersecting with respective longitudinal quilt seals, and lower lateral quilt seals traversing between third and fourth longitudinal columns and intersecting with respective longitudinal quilt seals, the longitudinal and lateral quilt seals defining a plurality of laterally extending passages having opposing open ends, the passages in communication with one another, the upper and lower lateral quilt seals configured to conform respective surface areas to an approximate planar shape upon inflation of the chamber.

2. The packaging device of claim 1, wherein the chamber includes first and second sub chamber portions disposed on opposing sides of the inner bag.

3. The packaging device of claim 2, further comprising a passage for openly communicating between the first and second sub chamber portions.

4. The packaging device of claim 1, further comprising a flow channel disposed on the outer bag and in communication with the chamber.

5. The packaging device of claim 1, wherein the adjacent inner and outer panels are sealed together to form five lateral quilt seals.

6. The packaging device of claim 1, wherein the adjacent inner and outer panels are sealed together to form bottom support seals adjacent a closed end of the device and traversing the surface of the inner and outer panels.

7. The packaging device of claim 6, wherein the bottom support seals extend from a lateral quilt seal.

8. The packaging device of claim 1, wherein the outer and inner panels are sealed together to form radial seals adjacent the aperture.

9. The packaging device of claim 1, wherein the outer and inner panels comprise a gas impervious, flexible material.

10. The packaging device of claim 1, wherein the upper lateral quilt seals are disposed non-equidistant from one another and the lower lateral quilt seals are disposed non-equidistant from one another.

11. A method for manufacturing an air packaging device, the method comprising:

sealing outer peripheral edges of a pair of overlying outer panels to form an outer bag and define a chamber therein;

securing a pair of overlying inner panels having inner peripheral edges to the outer bag to form an inner bag defining a pocket and suspended within the chamber; and sealing adjacent inner and outer panels to form, four symmetrical longitudinal columns, each longitudinal column having opposing ends spaced from one another and a plurality of longitudinal quilt seals, each longitudinal quilt seal having ends spaced from one another, each column approximating a surface edge upon inflation of the chamber, upper lateral quilt seals traversing between first and second longitudinal columns and intersecting with respective longitudinal quilt seals, and lower lateral quilt seals traversing between third and fourth longitudinal columns and intersecting with respective longitudinal quilt seals, the longitudinal and lateral quilt seals defining a plurality of laterally extending passages having opposing open ends, the passages in communication with one another, the upper and lower lateral quilt seals configured to conform respective surface areas to an approximate planar shape upon inflation of the chamber.

12. The method of claim 11 further comprising inflating the chamber with a filler medium.

13. The method of claim 11 further comprising disposing the inner bag within the chamber to thereby define first and second sub chamber portions on opposing sides of the inner bag.

14. The method of claim 13 further comprising forming a passage for openly communicating between the first and second sub chamber portions.

15. The method of claim 11 further comprising disposing a flow channel on the outer bag and in communication with the chamber.

16. The method of claim 11 wherein sealing adjacent inner and outer panels to form longitudinal and lateral quilt seals fuller comprises forming five lateral quilt seals.

17. The method of claim 11 further comprising sealing adjacent inner and outer panels together to form bottom support seals adjacent a closed end of the device.

18. The method of claim 11 further comprising sealing the outer and inner panels together to form radial seals adjacent the aperture.

19. An air packaging device, comprising:

an outer bag having upper and lower outer panels defining a chamber therein, the outer panels having outer peripheral edges sealed together along at least a portion of the outer peripheral edges;

an inner bag disposed within the chamber and secured to the outer bag, the inner bag having upper and lower inner panels having inner peripheral edges, the inner panels defining a pocket to retain an article therein;

upper longitudinal quilt seals disposed between the upper outer panel and the upper inner panel, the upper longitudinal quilt seals approximating surface edges upon inflation of the chamber;

upper lateral quilt seals disposed between the upper outer panel and the upper inner panel, the upper lateral quilt seals traversing between the upper longitudinal quilt seals and between the upper longitudinal quilt seals and the outer peripheral edges;

lower longitudinal quilt seals disposed between the lower outer panel and the lower inner panel, the lower longitudinal quilt seals approximating surface edges upon inflation of the chamber; and lower lateral quilt seals disposed between the lower outer panel and the lower inner panel, the lower lateral quilt seals traversing between the lower longitudinal quilt seals and between the lower longitudinal quilt seals and the outer peripheral edges.

20. The packaging device of claim 19, wherein the chamber includes first and second sub chamber portions disposed on opposing sides of the inner bag.

21. The packaging device of claim 20, further comprising a passage for openly communicating between the first and second sub chamber portions.

22. The packaging device of claim 19, further comprising a flow channel disposed on the outer bag and in communication with the chamber.

23. The packaging device of claim 19, further comprising:

upper bottom support seals disposed between the upper outer panel and the upper inner panel and traversing between an upper lateral quilt seal and an outer peripheral edge to define a first bottom surface area; and lower bottom support seals disposed between the lower outer panel and the lower inner panel and traversing between a lower lateral quilt seal and an outer peripheral edge to define a second bottom surface area.

24. The packaging device of claim 19 wherein the upper lateral quilt seals are disposed non-equidistant from one another and the lower lateral quilt seals are disposed non-equidistant from one another.

25. A method for manufacturing an air packaging device, the method comprising:

sealing at least a portion of outer peripheral edges of upper and lower outer panels to form an outer bag and define a chamber therein;

securing a pair of upper and lower inner panels having inner peripheral edges to the outer bag to form an inner bag suspended within the chamber, the inner bag defining a pocket for retaining an article therein;

forming upper longitudinal quilt seals between the upper outer panel and the upper inner panel, the upper longitudinal quilt seals configured to approximating surface edges upon inflation of the chamber;

forming upper lateral quilt seals between the upper outer panel and the upper inner panel, the upper lateral quilt seals traversing between the upper longitudinal quilt seals and between the upper longitudinal quilt seals and the outer peripheral edges;

forming lower longitudinal quilt seals between the lower outer panel and the lower inner panel, the lower longitudinal quilt seals configured to approximate surface edges upon inflation of the chamber; and forming lower lateral quilt seals between the lower outer panel and the lower inner panel, the lower lateral quilt seals traversing between the lower longitudinal quilt seals and between the lower longitudinal quilt seals and the outer peripheral edges.

26. The method of claim 25, wherein the chamber includes first and second sub chamber portions disposed on opposing sides of the inner bag.

27. The method of claim 25, further comprising forming a passage for openly communicating between the first and second sub chamber portions.

28. The method of claim 25, further comprising disposing a flow channel on the outer bag and in communication with the chamber.

29. The method of claim 25, further comprising:

forming upper bottom support seals between the upper outer panel and the upper inner panel such that the upper bottom support seals traverse between an upper lateral quilt seal and an outer peripheral edge to define a first bottom surface area; and forming lower bottom support seals between the lower outer panel and the lower inner panel such that the lower bottom support seals traverse between a lower lateral quilt seal and an outer peripheral edge to define a second bottom surface area.

* * * * *